US005307120A

United States Patent [19]

Ogawa

[11] Patent Number: 5,307,120

[45] Date of Patent: Apr. 26, 1994

[54] METHOD FOR MEASURING ELECTROSTATIC POTENTIAL

[75] Inventor: Takahiro Ogawa, Uji, Japan

[73] Assignee: Murata Kikai Kabushiki Kaisha, Kyoto, Japan

[21] Appl. No.: 826,783

[22] Filed: Jan. 28, 1992

[30] Foreign Application Priority Data

Jan. 29, 1991 [JP] Japan ..... 3-8850

[51] Int. Cl.[5] ..... G03G 15/02

[52] U.S. Cl. ..... 355/219; 355/203; 355/210; 324/452; 430/902

[58] Field of Search ..... 355/219, 203, 214, 210, 355/200, 211, 208; 346/154, 160; 324/452, 455, 457, 72, 109; 430/902, 35

[56] References Cited

U.S. PATENT DOCUMENTS 4,736,223 4/1988 Suzuki ..... 355/219
4,899,183 2/1990 Kitano et al. ..... 346/154
4,963,926 10/1990 Onishi et al. ..... 355/219 X
5,017,964 5/1991 Sadwick ..... 355/219
5,191,293 3/1993 Kreckel ..... 355/203 X

*Primary Examiner*—A. T. Grimley
*Assistant Examiner*—Shuk Y. Lee
*Attorney, Agent, or Firm*—Spensley Horn Jubas & Lubitz

[57] ABSTRACT

A method for measuring an electrostatic potential, in an electrophotographic type image forming apparatus to form an image using a photosensitive drum. An electrostatic potential measuring device is provided opposedly to the surface of the photosensitive drum, and at a position away from a position to which devices such as a charger are opposed, and the photosensitive drum is rotated, immediately after the photosensitive drum stops and the devices such as a charger is turned on for a fixed period of time, and at the same time, the measurement of an electrostatic potential of the surface of the photosensitive drum by the electrostatic potential measuring means is started.

2 Claims, 1 Drawing Sheet

METHOD FOR MEASURING ELECTROSTATIC POTENTIAL

BACKGROUND OF THE INVENTION

1. Field of the Invention

The present invention relates to an electrostatic potential measuring method for measuring a surface potential of a photosensitive drum used, for example, for a printer making use of an electrophotographic system or a copying machine.

2. Description of the Prior Art

Generally, in a printer or copying machine of this kind, a series of image forming processes are executed as described below. First, the surface of the photosensitive drum is uniformly charged in a dark place by a charging device. Next, an image portion of the charged surface of the photosensitive drum is illuminated by light through an exposing device, such as an LED array. At this time, a charge is removed from the image portion exposed to light (photoconductive phenomenon). An electrostatic latent image with a charge left thereon is formed on a portion other than the image portion not exposed to light of the photosensitive drum. Then, a toner (colored fine particles charged with the same polarity as the electrostatic latent image is supplied to the latent image by a developing unit to obtain a toner image (visible image). Further, a recording paper is overlaid on the toner image, and a charge with a polarity opposite to the charged polarity of the toner is applied to the recording paper by means of a transfer unit from the back of the recording paper. The toner image is then transferred to the recording paper by an electrostatic force. Heat or pressure is applied by a fuser to the transferred toner image and fused to the recording paper to provide a permanent image. On the other hand, the latent image charge on the photosensitive drum after transfer is discharged by a discharger (a discharging lamp). Any residual toner that is not transferred and remains on the photosensitive drum is removed by a cleaner.

The aforementioned latent image form is called a negative latent image, and in this case, the developing method is called a reversal developing method. On the other hand, in a copying machine or the like, a positive latent image is used as the latent image form, and in this case, a developing method called a normal developing method is used. In the positive latent image, portions other than the image portion are illuminated by an exposing device, conversely to the case of the negative latent image, to obtain an electrostatic latent image with a charge left on the image portion. In this case, a toner charged in polarity opposite to the electrostatic latent image is supplied to the latent image by the developing unit.

In the case where either the reversal developing method or the normal developing method is employed, attention is paid to the photosensitive drum. The electrostatic action, i.e., the charging or discharging action, is repeatedly carried out with respect to the surface of the drum. Here, to know the charging or discharging properties which comprise the characteristics of the photosensitive drum is very important, since formation of high quality image relies thereon. That is, if the charging or discharging properties which comprise the characteristics of the photosensitive drum are known, (in installation of devices which induce the electrostatic action such as a charger, a transfer unit or the like), it is possible to know the influence of the shape of the charger or the like on the operation thereof. It is further possible to determine an optimum installation place or remote distance with respect to the photosensitive drum, and it is possible to determine the optimum operating timing of the devices. Furthermore, for a photosensitive drum used for a long period of time, it is also possible to know the state of degradation of the photosensitive member being used. Generally, as a method for knowing the degree of the surface potential of the photosensitive drum, there is a potential measuring method using a surface potential meter. As the surface potential meter, various systems such as a radiation ionizing type, a DC amplifying type, an AC conversion type, etc. have been developed and used.

In individual machineries and devices such as a printer, a copying machine, etc., it is important for obtaining the optimum image formation to know the characteristics of photosensitive drums individually used. As for the example of a charging process, it is important for this process to charge the surface of the photosensitive drum quickly and uniformly to a predetermined potential. Accordingly, in this case, necessary information includes the optimum shape of a charger, the time required to reach a predetermined potential, and the distribution of potential on the photosensitive drum. Other necessary information includes attenuation in potential caused by exposure in the photosensitive drum, residual potential, charging record, durability, etc.

However, the value of the surface potential of the photosensitive drum measured by use of the surface potential meter is a mere average value obtained according to the number of measured samples. That is, since the photosensitive drum is rotating, the potential measured by the surface potential meter is merely obtained by sampling some of the instantaneous measured data at measuring points on the photosensitive drum and subjecting the resulting data to data processing. Consequently, according to such a measuring method as just mentioned, it is not possible to obtain information on whether or not the surface potential of the photosensitive drum reaches a predetermined potential after the passage of a predetermined time.

The present invention has been accomplished in view of the aforementioned circumstances. An object of the present invention is to provide an electrostatic potential measuring method capable of simply examining the optimum shape of a charger or the like, and various electrostatic characteristics of a photosensitive drum.

SUMMARY OF THE INVENTION

According to the present invention, there is provided a method for measuring an electrostatic potential, in an electrophotographic type image forming apparatus to form an image using a photosensitive drum, characterized in that electrostatic potential measuring means is provided opposedly to the surface of the photosensitive drum, and at a position away from a position to which devices (such as a charger) are opposed, and said photosensitive drum is rotated, immediately after said photosensitive drum stops and said devices (such as a charger) is turned on for a fixed period of time, and at the same time, the measurement of an electrostatic potential of the surface of the photosensitive drum by said electrostatic potential measuring means is started.

According to the aforementioned configuration, the electrostatic potential measuring means is provided opposedly of a position away from a position to which a charger or the like is opposed.

Prior to the measurement of the electrostatic potential of the surface of the photosensitive drum and in the state where the photosensitive drum is not rotated, the surface of the photosensitive drum is subjected to the electrostatic action, such as a charging action, by devices (such as a charger) for a fixed period of time. As a result, an the surface of the photosensitive drum, a potential distributed state continuous in left and right circumferential directions is formed about a position of the surface opposed to the charger or the like.

The devices (such as a charger) are turned off after the passage of a fixed period of time, and immediately the photosensitive drum starts to rotate. At the same time, the measurement of the potential distribution formed on the surface of the photosensitive drum is started by the electrostatic potential measuring means.

DETAILED DESCRIPTION OF THE PREFERRED EMBODIMENTS

Figure 1:
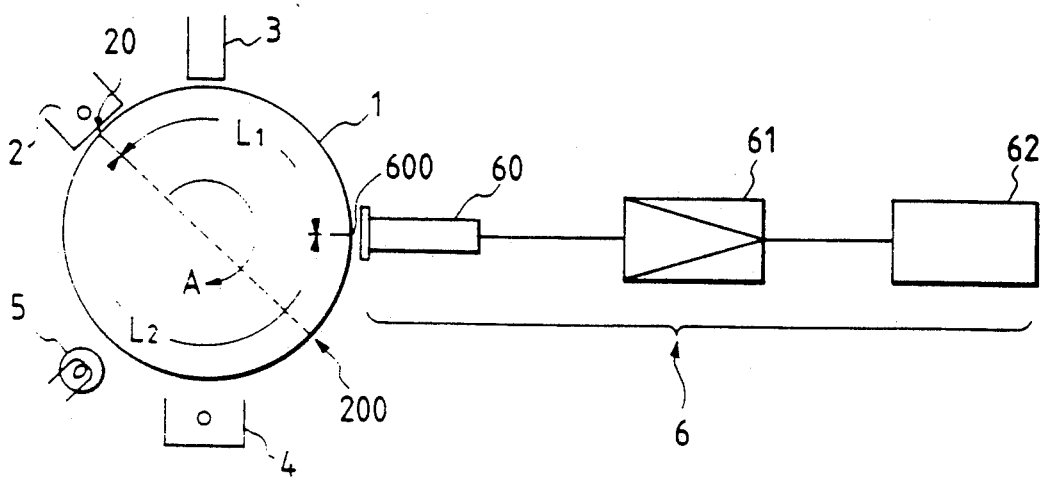
FIG. 1 is a view showing an arrangement of devices for examining the charged state of the surface of the photosensitive drum using an electrostatic potential measuring method according to the present invention.

As will be apparent from FIG. 1, a charger 2, an exposing device 3, a transfer unit 4 and a discharging lamp 5 are arranged in the periphery of a photosensitive drum 1, and an electrostatic potential measuring device 6 is arranged on the right side of the photosensitive drum 1 as viewed in the figure. In the case of performing an image formation, the electrostatic potential measuring device 6 is arranged at a location where a developing unit is arranged, but the measuring device 6 is not necessary for the purpose of examining the charging characteristics of the photosensitive drum and therefore is removed.

The electrostatic potential measuring device 6 consists of a probe 60, a potential meter 61 and a recording meter 62. The probe 60 is a sensor portion for detecting a surface potential of the photosensitive drum 1, and the potential meter body 61 is a portion which amplifies and processes a signal from the probe 60. The recording meter 62 continuously records surface potentials measured. The distance between the probe 60 and the photosensitive drum 1 is suitably determined according to the characteristics of the electrostatic potential measuring device. In the case of performing the measurement of potential, care should be taken so that the environment of measurement is always kept clean, and a dielectric (for example, toner particle) or the like having a potential is prevented from adhering to the surface of the probe 60 to generate a contact potential difference.

In the measurement of potential distribution on the surface of the photosensitive drum 1, it is necessary to clarify the purpose of measurement. More specifically, in the case of using the charger 2, the charging characteristic of the photosensitive drum 1 is examined; in the case of using the exposing device 3, the potential drop characteristic of the surface of the photosensitive drum 1 due to the exposure is examined; in the case of using the transfer unit 4, the discharging characteristic from the surface of the photosensitive drum 1 is examined; in case of using the discharging lamp 5, the potential drop characteristic of the surface of the photosensitive drum 1 due to the exposure is examined; and in the discharge, the residual potential characteristic in the surface of the photosensitive drum 1 is examined.

The charger 2 and the electrostatic potential measuring device 6 are used to examine the charging characteristic of the surface of the photosensitive drum 1. This example will be described below on the basis of the electrostatic potential measuring method according to the present invention. First, the charger 2 is turned on for a fixed period of time (several msec) without rotating the photosensitive drum 1, and the surface of the photosensitive drum 1 is charged. Thereafter, the charger 2 is turned off. At the same time, the photosensitive drum 1 starts to rotate in a direction as indicated by arrow A, and the measurement of potential is started by the electrostatic potential measuring device 6. The measuring time is for example, 0.5 second. In this case, it is necessary to set a charging potential of the photosensitive drum to 0V (ground level) before measurement.

If the charger 2 is turned on for a fixed period of time as described above, an opposed surface 20 on the surface of the photosensitive drum 1 located nearest to the charger 2 is charged to the highest potential. The charged potential becomes lower as one moves away toward the left or right peripheral directions on the surface of the photosensitive drum 1, with the opposed surface 20 as a reference. Since the left and right peripheral remote distances $L_1$ and $L_2$ on the photosensitive drum 1 of a measuring surface 600 opposed to the electrostatic potential measuring device 6 and the opposed surface 20 of the charger 2 are not equal in length, the potential of the measuring surface 600 is the charged potential according to the short remote distance $L_1$. In this case, in the charging of several msec, the potential at the measuring surface 600 is almost close to a zero potential.

Next, when the photosensitive drum 1 rotates in a direction as indicated by arrow A, the potential distributions at respective positions on the surface of the photosensitive drum 1 with respect to the measuring surface 600 change. Therefore, if these potential distributions are continuously measured by the electrostatic potential measuring device 6, it is possible to know the charging characteristics of the individual photosensitive drum 1.

Figure 2:
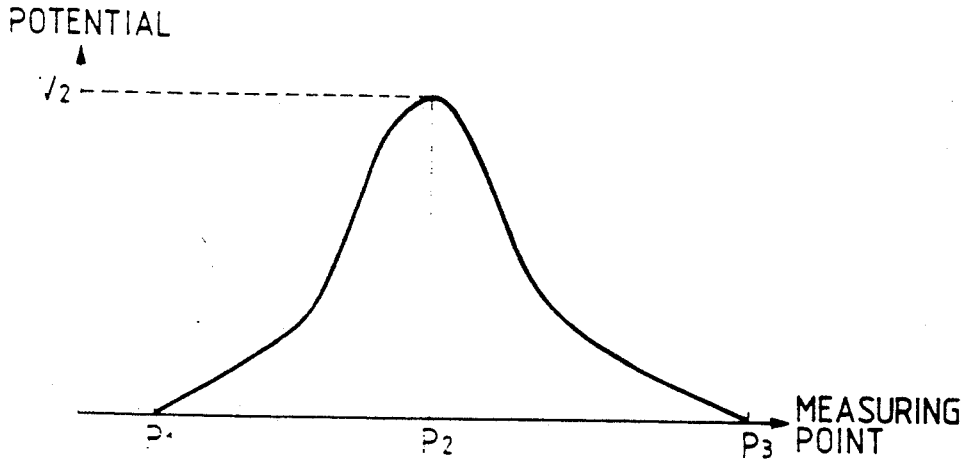
FIG. 2 is a graph showing the distribution of the charged potential of the surface of the photosensitive drum by the charger, measured by the electrostatic potential measuring method according to the present invention.

FIG. 2 is a graph showing the charged potential distribution of the surface of the photosensitive drum 1 by the charger 2, measured by the electrostatic potential measuring method according to the present invention. The ordinate axis indicates a potential, and the abscissa axis indicates a measured point. In this graph, the point $P_1$ is the position of the surface of the photosensitive drum 1 to which the electrostatic potential measuring device 6 is first opposed, and the point $P_2$ is the position of the surface of the photosensitive drum 1 to which the charger 2 is first opposed. The point $P_3$ is the position corresponding to the surface 200 positioned true-opposite to the point $P_2$ on the surface of the photosensitive drum 1.

A potential $V_2$ at the point $P_2$ corresponding to the position to which the charger 2 is opposed is largest, as will be apparent from the graph. This is the position closest to the charger 2 and the position most subjected to the charging action by the charger 2, on the surface of the photosensitive drum 1. Therefore, the above is a natural result. In the actual measurement, a graph showing delicately different charging potentials on the individual photosensitive drum 1 is obtained. The shape of the graph corresponds exactly to the individual charging characteristic of the photosensitive drum 1. Accordingly, it is possible to examine the delicate characteristic of the photosensitive drum 1 from the obtained shape of the graph. The charging response or the transmission characteristic of the surface of the photosensitive drum 1 is known from a rising degree of potential from point $P_1$ to point $P_2$ and the magnitude of the peak value of potential at the point $P_2$. Conversely, this will be useful information to know the characteristic of the charger 2.

Further, if the setting position of the probe 60 with respect to the photosensitive drum 1 is shifted widthwise of the photosensitive drum 1, it is possible to obtain information of the charging characteristic of the entire surface of the photosensitive drum 1. In this case, it is also possible to know the state of partial degradation in the surface of the photosensitive drum 1.

If the recording meter 62 has a memory function, it is possible to increase the number of samplings of measured data by the probe 60, thus improving the resolution of the graph. By doing this, it is possible to examine in more detail a difference of delicate characteristics in the individual photosensitive drum 1. In the actual measurement, it is desirable that all the devices, such as the electrostatic potential measuring device 6, the photosensitive drum 1, the charger 2 and the like, are controlled by a CPU with good timing.

While in the above-described embodiment, an example has been described in which the electrostatic potential measuring method is merely applied to the charging characteristic of the photosensitive drum 1, it is to be noted that the method can be applied to the measurement of potential variation of the surface of the photosensitive drum in the discharge by the exposing device 3, the discharge by the transfer unit 4, and the discharge by the discharging lamp 5.

According to the present invention, the state of the potential distribution of the surface of the photosensitive drum can be accurately measured with an extremely simple configuration in which the electrostatic potential measuring device is merely set to the photosensitive drum. Accordingly, it is possible to accurately grasp various electrostatic characteristics of the individual photosensitive drum used for the printer, copying machine, etc., and in forming an image of high quality, various important informations can be obtained.

Furthermore, the measurement of an electrostatic potential can be made also during the assembling of devices, and can be also made after assembling. Accordingly, this can be widely applied to the examination of the photosensitive drum or the research of the state of degradation of the photosensitive drum after use for a long period of time. Moreover, the measuring method is extremely simple and is easily handled.

What is claimed is:

1. In an electrophotographic apparatus for forming an image using a rotatable, photosensitive drum having drum surface, a method for measuring an electrostatic potential associated with the drum surface, the method comprising;

providing, in spaced relationship with the drum surface, a device for affecting the electrostatic potential of the drum surface, providing, in spaced relationship with the drum surface, a device for measuring the electrostatic potential of the drum surface, the device for affecting the electrostatic potential of the drum surface and the device for measuring the electrostatic potential of the drum surface being in mutually spaced relationship, activating the device for affecting the electrostatic potential of the drum surface for a fixed period of time during which the drum is not rotated, rotating the drum after activating the device for affecting the electrostatic potential of the drum surface, and initiating the measurement of an electrostatic potential distribution of the drum surface by the electrostatic potential measuring means, whereby a substantially continuous distribution of the electrostatic potential of the drum along at least a portion of the peripheral surface of the drum is obtained.

2. The method according to claim 1, comprising:

generating a signal corresponding to the measured electrostatic potential of the drum surface, amplifying and processing the signal corresponding to the measured electrostatic potential of the drum surface, and recording the signal corresponding to the measured electrostatic potential of the drum surface.

* * * * *